US008998357B2

(12) United States Patent
Igarashi

(10) Patent No.: US 8,998,357 B2
(45) **Date of Patent: *Apr. 7, 2015**

(54) LIQUID EJECTION APPARATUS

(75) Inventor: Akinori Igarashi, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 52 days.

This patent is subject to a terminal disclaimer.

(21) Appl. No.: 13/191,024

(22) Filed: Jul. 26, 2011

(65) Prior Publication Data

US 2012/0026221 A1 Feb. 2, 2012

(30) Foreign Application Priority Data

Jul. 30, 2010 (JP) ..... 2010-172237

(51) Int. Cl.

| | |
|---|---|
| ***B41J 2/195*** | (2006.01) |
| ***B41J 2/165*** | (2006.01) |
| ***B41J 2/18*** | (2006.01) |
| ***B41J 2/19*** | (2006.01) |
| ***B41J 2/20*** | (2006.01) |

(52) U.S. Cl.

CPC ..... *B41J 2/16526* (2013.01); *B41J 2/18* (2013.01); *B41J 2/19* (2013.01); *B41J 2/20* (2013.01)

(58) Field of Classification Search

USPC ..... 347/7, 84, 85, 89, 5, 86

See application file for complete search history.

(56) References Cited

U.S. PATENT DOCUMENTS

| | | | |
|---|---|---|---|
| 4,800,403 | A | 1/1989 | Accattino et al. |
| 6,056,387 | A | 5/2000 | Kaneko |
| 6,231,174 | B1 | 5/2001 | Haigo |
| 7,347,520 | B2 | 3/2008 | Ito |

(Continued)

FOREIGN PATENT DOCUMENTS

| | | | |
|---|---|---|---|
| CN | 1863677 | A | 11/2006 |
| CN | 101314285 | A | 12/2008 |

(Continued)

OTHER PUBLICATIONS

Extended European Search Report dated Oct. 27, 2011 from related European Patent Application 11175388.5.

(Continued)

*Primary Examiner* — Lam S Nguyen

(74) *Attorney, Agent, or Firm* — Scully, Scott, Murphy & Presser, PC

(57) ABSTRACT

A liquid ejection apparatus including: a liquid ejection head including an inside channel; a supply channel; a return channel; a supply device; an adjusting device; and a controller, wherein the controller starts a liquid circulation control for circulating liquid through the supply channel, the inside channel, and the return channel in order by controlling: the adjusting device such that a channel resistance value of the return channel is less than a predetermined maximum value; and the supply device to supply the liquid into the inside channel, wherein, when the liquid is circulated, the controller starts a liquid discharge control for discharging the liquid by increasing the channel resistance value, wherein, when the liquid is discharged, the controller starts a liquid-discharge stopping control for stopping the discharge by decreasing the channel resistance value, and wherein the controller controls the supply device such that a liquid amount supplied to the inside channel per unit time when the discharge is stopped is less than that in the liquid circulation control.

8 Claims, 12 Drawing Sheets

(56) References Cited

U.S. PATENT DOCUMENTS

| | | | |
|---|---|---|---|
| 7,874,656 | B2 | 1/2011 | Ota et al. |
| 8,038,267 | B2 | 10/2011 | Kinase et al. |
| 2002/0060713 | A1 | 5/2002 | Katakura et al. |
| 2005/0212874 | A1 | 9/2005 | Nomura et al. |
| 2006/0007254 | A1 | 1/2006 | Tanno et al. |
| 2006/0103700 | A1 | 5/2006 | Taira |
| 2006/0132554 | A1 | 6/2006 | Ota et al. |
| 2006/0176330 | A1 | 8/2006 | Ito |
| 2007/0120912 | A1 | 5/2007 | Lim et al. |
| 2007/0211106 | A1 | 9/2007 | Eguchi et al. |
| 2008/0239027 | A1 | 10/2008 | Kinase et al. |
| 2008/0273064 | A1 | 11/2008 | Ota et al. |
| 2008/0297546 | A1 | 12/2008 | Lee et al. |
| 2009/0002467 | A1 | 1/2009 | Watanabe |
| 2009/0289976 | A1 | 11/2009 | Nishimura |
| 2010/0321424 | A1 | 12/2010 | Tamaki |

FOREIGN PATENT DOCUMENTS

| | | | |
|---|---|---|---|
| CN | 101332714 | A | 12/2008 |
| EP | 0884185 | A2 | 12/1998 |
| EP | 0 903 235 | A2 | 3/1999 |
| EP | 0 916 502 | A2 | 5/1999 |
| EP | 1 790 482 | A2 | 5/2007 |
| JP | S63107561 | A | 5/1988 |
| JP | H11078067 | A | 3/1999 |
| JP | H11-268302 | A | 10/1999 |
| JP | H11-300988 | A | 11/1999 |
| JP | 2000-025245 | A | 1/2000 |
| JP | 2002361908 | A | 12/2002 |
| JP | 2004-230906 | A | 8/2004 |
| JP | 2005-306005 | | 11/2005 |
| JP | 2006-168339 | A | 6/2006 |
| JP | A-2006-159811 | | 6/2006 |
| JP | A-2006-213021 | | 8/2006 |
| JP | 2006-315200 | A | 11/2006 |
| JP | A-2008-55646 | | 3/2008 |
| JP | A-2008-264767 | | 11/2008 |
| JP | A-2009-006729 | | 1/2009 |
| JP | 2009-29111 | | 2/2009 |
| JP | 2009-279816 | | 12/2009 |
| JP | 2010162728 | A | 7/2010 |
| JP | 2011-834 | | 1/2011 |
| WO | WO 2006/064040 | A1 | 6/2006 |

OTHER PUBLICATIONS

Notification of Reason for Refusal dated Nov. 27, 2012 received from the Japanese Patent Office from related Japanese Application No. 2010-172237, together with an English-language translation.

Notification of Reason for Refusal dated Nov. 27, 2012 received from the Japanese Patent Office from related Japanese Application No. 2010-172235 and U.S. Appl. No. 13/191,003, together with an English-language translation.

Extended European Search Report dated Oct. 27, 2011 from related European Patent Application 11175406.5 and U.S. Appl. No. 13/191,003.

U.S. Office Action received in related U.S. Appl. No. 13/191,003, filed Jul. 26, 2011.

Notification of Reason for Refusal dated Aug. 6, 2013 received from the Japanese Patent Office from counterpart Japanese Application No. 2010-172237 together with English translation.

Notification of First Office Action dated Aug. 27, 2013 received from the Chinese Patent Office from counterpart Chinese Application No. 201110214614.6 together with English translation.

Notification of Reason for Refusal dated Sep. 3, 2013 received from the Japanese Patent Office from counterpart Japanese Application No. 2010-172239 together with English translation from related U.S. Appl. No. 13/191,003.

Notification of First Office Action dated Sep. 2, 2013 received from the Chinese Patent Office from counterpart Chinese Application No. 201110214611.2 together with English translation from related U.S. Appl. No. 13/191,003.

U.S. Final Office Action dated Nov. 7, 2013 received in related U.S. Appl. No. 13/191,003, filed Jul. 26, 2011.

U.S. Official Action dated Apr. 17, 2014 from related U.S. Appl. No. 13/191,003.

Japanese Office Action dated May 27, 2014 in counterpart Japanese Patent Application No. 2010-172239.

U.S. Official Action dated Oct. 6, 2014 from related U.S. Appl. No. 13/191,003.

Notification of Second Office Action dated Jul. 8, 2014 received from the Chinese Patent Office from counterpart Chinese Application No. 201110214611.2, from related U.S. Appl. No. 13/191,003, together with an English language translation.

European Office Action dated Oct. 7, 2014 from related Application No. EP 11 175 406.5 of related U.S. Appl. No. 13/191,003.

European Office Action dated Oct. 7, 2014 from related Application No. EP 11 175 388.5.

LIQUID EJECTION APPARATUS

CROSS REFERENCE TO RELATED APPLICATION

The present application claims priority from Japanese Patent Application No. 2010-172237, which was filed on Jul. 30, 2010, the disclosure of which is herein incorporated by reference in its entirety.

BACKGROUND OF THE INVENTION

1. Field of the Invention

The present invention relates to a liquid ejection apparatus configured to eject liquid from ejection openings.

2. Description of the Related Art

There is known an ink jethead configured to eject ink droplets from a plurality of ejection openings and perform a cleaning for the ejection openings by forcibly supplying the ink into ink channels in the ink-jet head by a pump and to discharge air bubbles and thickened or viscous ink remaining in portions of the ink channels which are located near the ejection openings. For example, after a three-way valve is closed to close and seal a discharging passage, a supply pump is operated to pressurize the ink in the ink channels for a predetermined length of time, thereby discharging the ink from nozzles to perform the cleaning of the nozzles.

SUMMARY OF THE INVENTION

In order to perform a cleaning of ejection openings by reliably discharging ink from all the ejection openings, an ink pressure applied to ink channels needs to be increased to a desired pressure. However, if a relatively long time is required for the ink pressure in the ink channels to reach the desired pressure after the pump starts to be driven, the ink is discharged from the ejection openings in the order of their ink-discharge resistances or channel resistances, an ejection opening having the lowest ink-discharge resistance first. This makes it impossible to instantaneously discharge the ink from all the ejection openings at the same time. Thus, the ink is needlessly discharged from the ejection openings in the cleaning of the ejection openings. Further, since meniscus withstanding pressures of the ejection openings are lowered by adhesion of the discharged ink to portions defining the ejection openings, the ink may leak from the ejection openings also by slight ink flow in the ink channels, leading to unnecessary ink discharge.

This invention has been developed in view of the above-described situations, and it is an object of the present invention to provide a liquid ejection apparatus configured to efficiently discharge liquid and air bubbles and the like from ejection openings while preventing unnecessary consumption of the liquid.

The object indicated above may be achieved according to the present invention which provides a liquid ejection apparatus comprising: a liquid ejection head including: an inlet opening into which liquid flows; an outlet opening from which the liquid having flowed into the inlet opening flows; an inside channel communicating the inlet opening and the outlet opening with each other; and a plurality of ejection openings through which is ejected the liquid having flowed through a plurality of individual channels that are branched from the inside channel; a tank storing the liquid to be supplied to the liquid ejection head; a supply channel communicating the tank and the inlet opening with each other; a return channel communicating the tank and the outlet opening with each other; a supply device configured to supply the liquid in the tank to the inside channel via the supply channel; an adjusting device configured to adjust a channel resistance value of the return channel between a predetermined minimum value and a predetermined maximum value; and a controller configured to control the supply device and the adjusting device, wherein the controller is configured to start a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein, when the liquid is circulated by the liquid circulation control, the controller starts a liquid discharge control for discharging the liquid from the plurality of the ejection openings by increasing the channel resistance value to a value larger than the channel resistance value in the liquid circulation control, wherein, when the liquid is discharged by the liquid discharge control, the controller starts a liquid-discharge stopping control for stopping the discharge of the liquid from the plurality of the ejection openings, by decreasing the channel resistance value to a value less than the channel resistance value in the liquid discharge control, and wherein the controller is configured to control the supply device such that a unit-time supply amount that is an amount of the liquid supplied to the inside channel per unit time at a time when the discharge of the liquid from the plurality of the ejection openings is stopped by the liquid-discharge stopping control is less than a unit-time supply amount in the liquid circulation control.

The object indicated above may also be achieved according to the present invention which provides a liquid ejection apparatus comprising: a liquid ejection head including: an inlet opening into which liquid flows; an outlet opening from which the liquid having flowed into the inlet opening flows; an inside channel communicating the inlet opening and the outlet opening with each other; and a plurality of ejection openings through which is ejected the liquid having flowed through a plurality of individual channels that are branched from the inside channel; a tank storing the liquid to be supplied to the liquid ejection head; a supply channel communicating the tank and the inlet opening with each other; a return channel communicating the tank and the outlet opening with each other; a supply device configured to supply the liquid in the tank to the inside channel via the supply channel; an adjusting device provided at a predetermined area expanding from the outlet opening of the inside channel, and configured to adjust a channel resistance value of the liquid in the predetermined area between a predetermined minimum value and a predetermined maximum value; and a controller configured to control the supply device and the adjusting device, wherein the controller is configured to start a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein, when the liquid is circulated by the liquid circulation control, the controller starts a liquid discharge control for discharging the liquid from the plurality of the ejection openings by increasing the channel resistance value to a value larger than the channel resistance value in the liquid circulation control, wherein, when the liquid is discharged by the liquid discharge control, the controller starts a liquid-discharge stopping control for stopping the discharge of the liquid from the plurality of the ejection openings, by decreasing the channel resistance value to a value less than the channel resistance value in the liquid discharge control, and wherein the controller is configured to control the supply device such that a unit-time supply amount that is an amount of the liquid supplied to the inside channel per unit time at a time when the discharge of the liquid from the plurality of the ejection openings is stopped by the liquid-discharge stopping control is less than a unit-time supply amount in the liquid circulation control.

In the image liquid ejection apparatuses constructed as described above, air bubbles, foreign matters, and the like remaining in the inside channel can be discharged into the tank by the liquid circulation while preventing the liquid from leaking from the ejection openings. Further, the channel resistance value is increased by the adjustment of the adjusting device in this state to momentarily increase a pressure in the inside channel, whereby the liquid in the inside channel flows into the individual channels so as to be discharged from the ejection openings. In this operation, a relatively high pressure is applied to all the ejection openings from the start of the liquid discharge control to discharge the liquid in the ejection openings. Accordingly, it is possible to efficiently discharge thickened liquid in the ejection openings, the air bubbles, and the foreign matters, and it is possible to prevent the liquid from being discharged needlessly. Further, the unit-time supply amount at an end of the liquid discharge control is less than that in the liquid circulation control. Thus, even where a meniscus withstanding pressure of a meniscus formed in the ejection openings has been lowered because the liquid discharged in a previous discharging has adhered to defining portions of the ejection openings, it is possible to prevent the liquid from leaking from the ejection openings after the end of discharging of the liquid.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
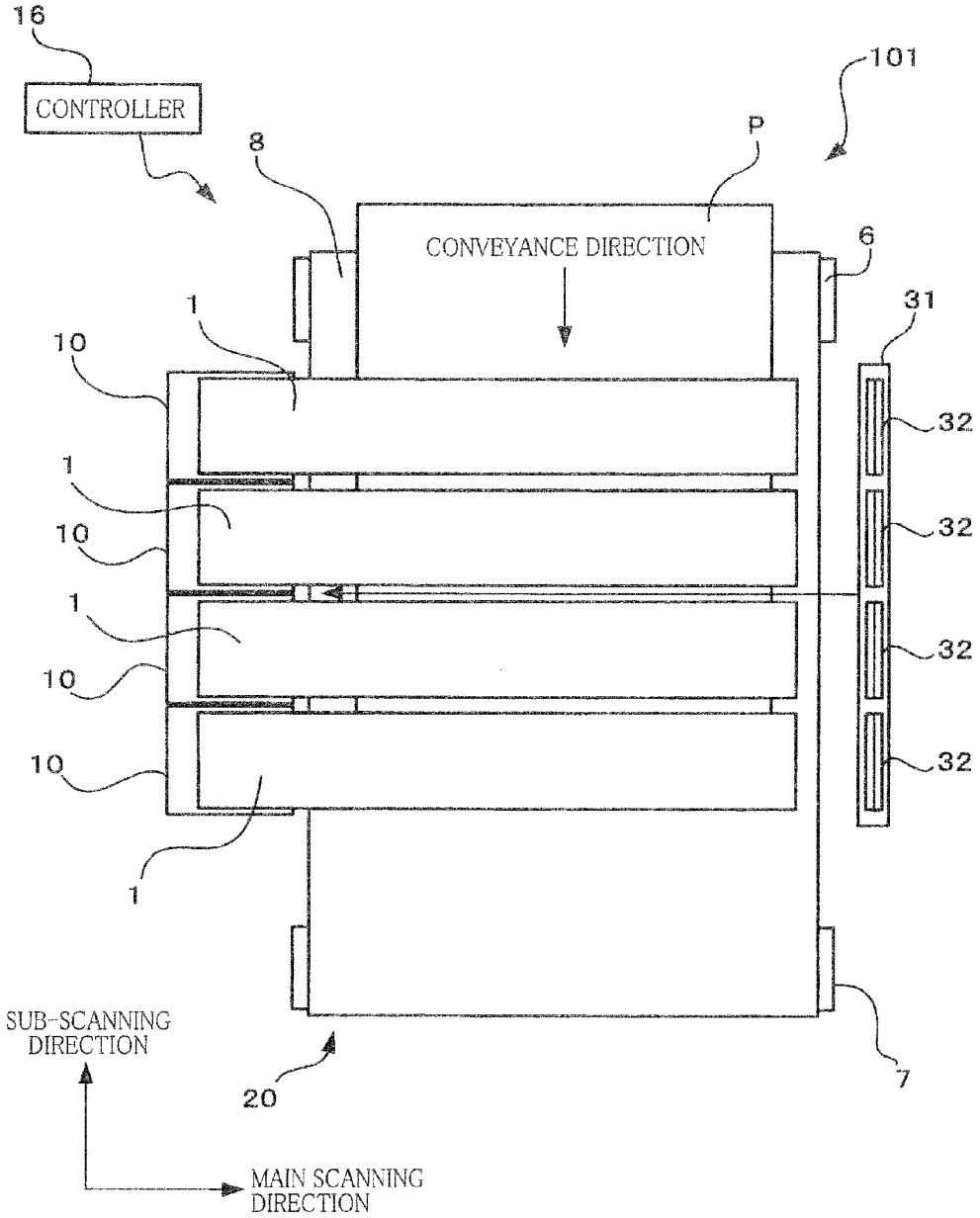
FIG. 1 is a plan view generally showing an ink-jet printer as one embodiment of the present invention.

As shown in FIG. 1, an ink jetprinter 101 as one example of a liquid ejection apparatus includes: (a) a sheet conveyance unit 20 configured to convey a sheet P from an upper side toward a lower side in FIG. 1; (b) four ink jetheads 1 (each as one example of liquid ejection head) configured to eject droplets of inks of respective four colors, namely, black, magenta, cyan, and yellow onto the sheet P conveyed by the conveyance unit 20; four ink supply units 10 configured to respectively supply the inks to the ink-jet heads 1; a maintenance unit 31 configured to perform a maintenance for ink jetheads 1; and a controller 16 configured to control entire operations of the ink jet printer 101. It is noted that, in the present embodiment, a sub-scanning direction is a direction parallel to a conveyance direction in which the conveyance unit 20 conveys the sheet P, and a main scanning direction is a direction perpendicular to the sub-scanning direction and along a horizontal plane.

The conveyance unit 20 includes two belt rollers 6, 7 and an endless sheet conveyance belt 8 wound around the rollers 6, 7. The belt roller 7 is a drive roller that is rotated by a drive power from a conveyance motor, not shown. The belt roller 6 is a driven roller that is rotated in accordance with the running or rotation of the conveyance belt 8 which is caused by the rotation of the belt roller 7. The sheet P placed on an outer circumferential face of the conveyance belt 8 is conveyed toward the lower side in FIG. 1.

The four ink-jet heads 1 each extends in the main scanning direction and are disposed in parallel with one another in the sub-scanning direction. That is, the ink-jet printer 101 is a line-type color ink-jet printer in which a plurality of ejection openings 108 through which the ink droplets are ejected are arranged in the main scanning direction. A lower face of each ink jethead 1 functions as an ejection face 2*a* in which the plurality of the ejection openings 108 are formed (see FIGS. 2-4).

An outer circumferential face of an upper portion of the conveyance belt 8 and the ejection faces 2*a* face and parallel with each other. When the sheet P conveyed on the conveyance belt 8 passes through positions just under the four ink jet heads 1, the ink droplets of four colors are ejected in order from the respective ink jet heads 1 onto an upper face of the sheet P, whereby a desired color image is formed on the sheet P.

Each of the ink supply units 10 is connected to a left end portion of the lower face of a corresponding one of the ink-jet heads 1 in FIG. 1 so as to supply the ink to the corresponding ink-jet head 1.

The maintenance unit 31 includes four wiper members 32. Each of the wiper members 32 is an elastic member for wiping the ejection face 2*a* of a corresponding one of the ink jetheads 1 in a wiping operation of a maintenance operation which will be described below. Each wiper member 32 is reciprocable by an actuator, not shown, in the main scanning direction (indicated by an arrow in FIG. 1).

Figure 2:
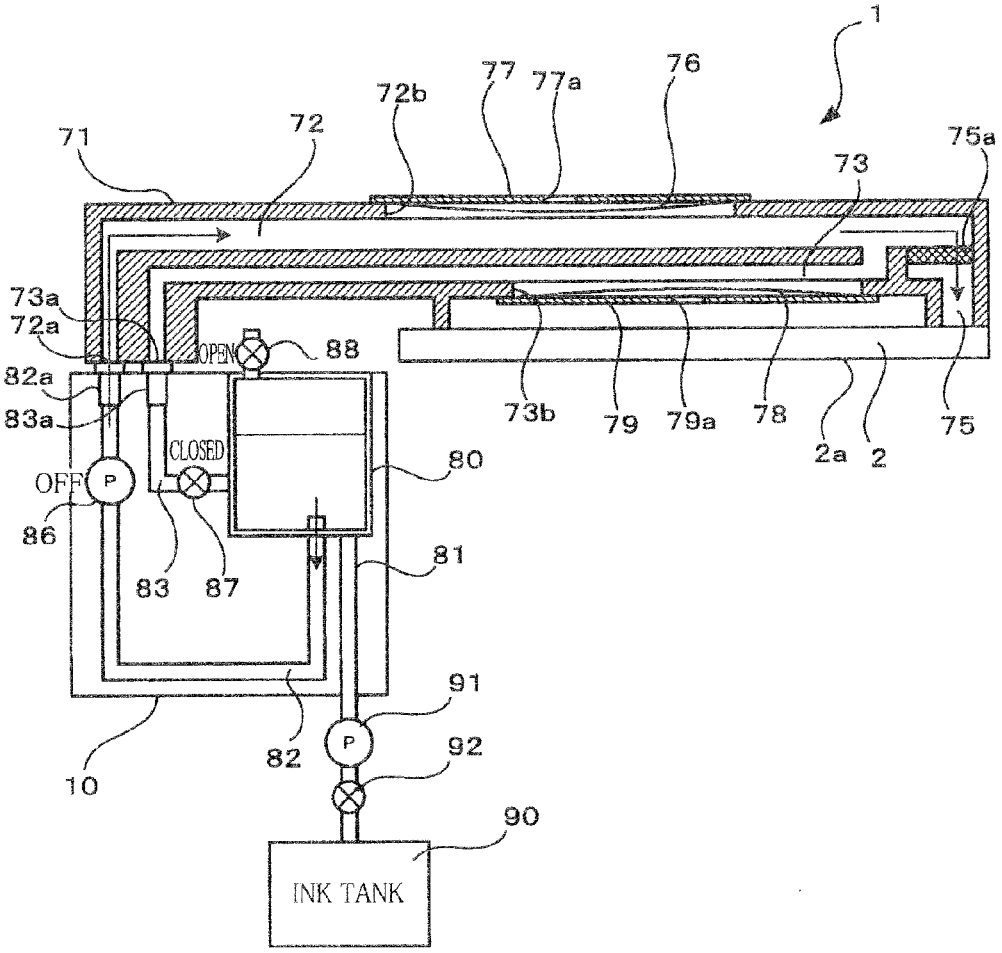
FIG. 2 is a cross-sectional view showing an ink-jet head and an ink supply unit shown in FIG. 1.

There will be next explained the ink-jet heads 1 in detail with reference to FIG. 2. As shown in FIG. 2, each ink-jet head 1 includes a reservoir unit 71 and a head main body 2.

The reservoir unit 71 is a channel defining member that is fixed to an upper face of the head main body 2 and supplies the ink to the head main body 2. The reservoir unit 71 has an ink inlet channel 72 (as one example of an inside channel), ten ink outlet channels 75, and a discharge channel 73 (as another example of an inside channel) formed therein. It is noted that only a single ink outlet channel 75 is shown in FIG. 2.

The ink inlet channel 72 is a channel into which the ink from the ink supply unit 10 flows via an inlet opening 72*a* opened in a lower face of the reservoir unit 71. The ink inlet channel 72 functions as an ink reservoir for temporarily storing the flowed ink. In an inner wall face of the ink inlet channel 72, there is formed a hole 72*b* formed through an outer wall face of the reservoir unit 71. The hole 72*b* is sealed by a flexible resin film 76 from a side of the hole 72*b* which is nearer to the outer wall face of the reservoir unit 71. That is, the resin film 76 partly constitutes the inner wall face of the ink inlet channel 72. In other words, at least a part of the inner wall face of the ink inlet channel 72 is formed of a flexible material. The resin film 76 is displaced according to changes of a pressure of the ink in the ink inlet channel 72, functioning as a damper for restraining the changes of the ink pressure. Using the resin film 76 enables to provide the damper at low cost. It is noted that, in a normal recording, the resin film 76 slightly projects toward an inside of the ink inlet channel 72. To the outer wall face of the reservoir unit 71 is fixed a plate-like restraining member 77 so as to cover the hole 72*b*, thereby restraining the resin film 76 from projecting toward an outside of the reservoir unit 71. As a result, it is possible to prevent the resin film 76 from being broken by being excessively displaced when the ink pressure in the ink inlet channel 72 becomes excessively high. In the restraining member 77 is formed an air communicating hole 77*a* that always keeps a pressure between the restraining member 77 and the resin film 76 at an atmospheric pressure. This facilitates the displacement of the resin film 76.

Figure 3:
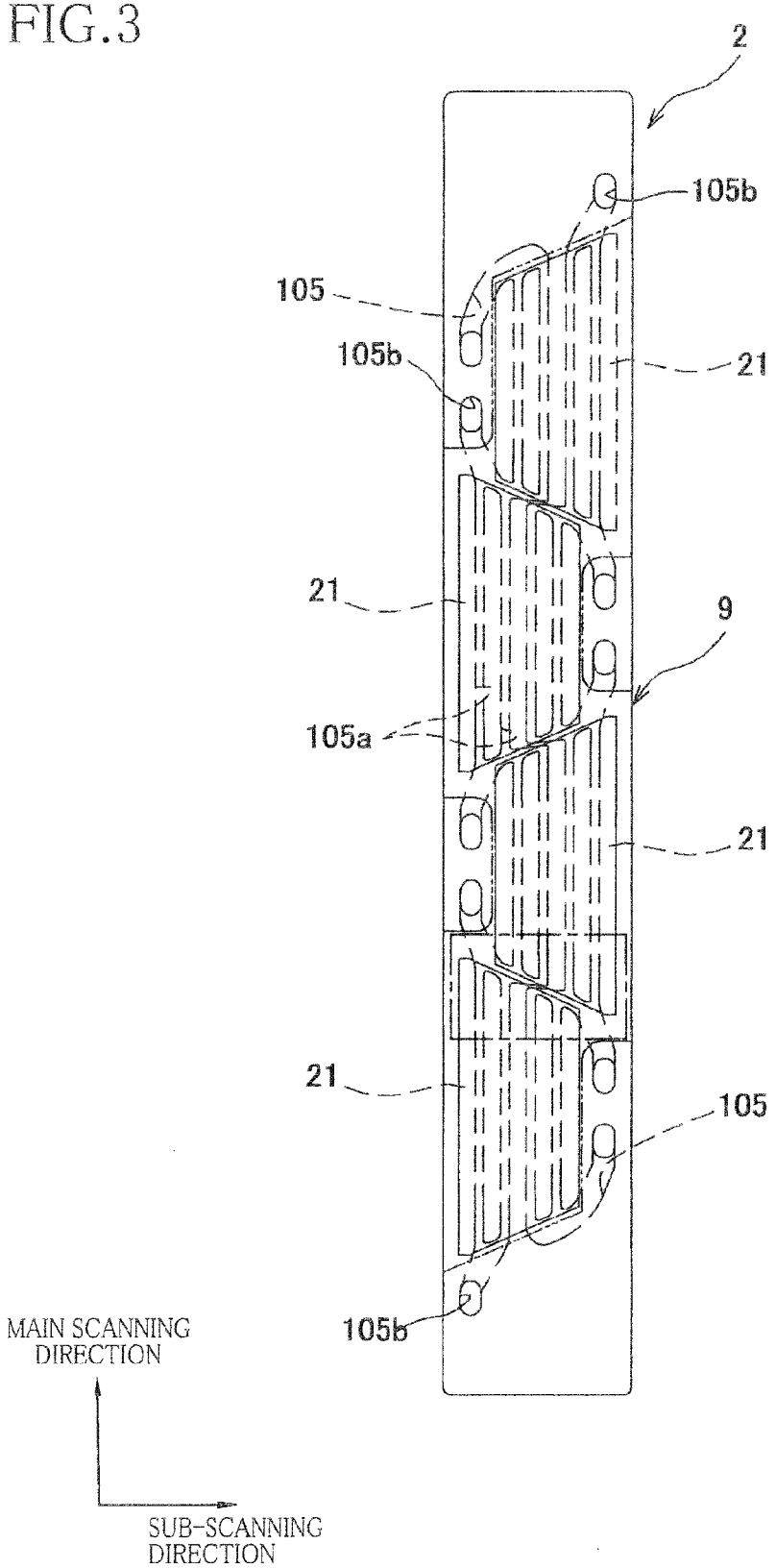
FIG. 3 is a plan view showing a head main body shown in FIG. 2.

The ink outlet channels 75 communicate with the ink inlet channel 72 via a filter 75*a* and with ink supply openings 105*b* formed in an upper face of a channel unit 9 (see FIG. 3). The filter 75*a* extends in a direction in which the ink flows in the ink inlet channel 72 (i.e., in the rightward and leftward direction in FIG. 2). In the normal recording, the ink supplied from the ink supply unit 10 flows into the ink inlet channel 72, then passes through the ink outlet channels 75, and finally is supplied from the ink supply openings 105*b* to the channel unit 9.

The discharge channel 73 communicates with the ink inlet channel 72 at a portion thereof located on an upstream side of the filter 75*a* and is connected to the ink supply unit 10 via an outlet opening 73*a* formed in the lower face of the reservoir unit 71.

In a lower inner wall face of the discharge channel 73, there is formed a hole 73*b* formed through the outer wall face of the reservoir unit 71. The hole 73*b* is sealed by a flexible resin film 78 from a lower side of the hole 73*b*, i.e., from a side of the hole 73*b* which is nearer to the outer wall face of the reservoir unit 71. That is, the resin film 78 partly constitutes the inner wall face of the discharge channel 73. In other words, at least a part of the inner wall face of the discharge channel 73 is formed of a flexible material. The resin film 78 is displaced according to changes of a pressure of the ink in the discharge channel 73, functioning as a damper for restraining the changes of the ink pressure. Using the resin film 78 enables to provide the damper at low cost. It is noted that, in the normal recording, the resin film 78 slightly projects toward an inside of the discharge channel 73. To the lower outer wall face of the reservoir unit 71 is fixed a plate-like restraining member 79 so as to cover the hole 73*b*, thereby restraining the resin film 78 from projecting toward an outside of the reservoir unit 71. As a result, it is possible to prevent the resin film 78 from being broken by being excessively displaced when the ink pressure in the discharge channel 73 becomes excessively high. In the restraining member 79 is formed an air communicating hole 79*a* that always keeps a pressure between the restraining member 79 and the resin film 78 at the atmospheric pressure. This facilitates the displacement of the resin film 78. In ink circulation which will be described below, the ink supplied from the ink supply unit 10 flows into the ink inlet channel 72 via the inlet opening 72*a*, then passes from the ink inlet channel 72 through the discharge channel 73, and finally returns to the ink supply unit 10 via the outlet opening 73*a* (see FIG. 9).

Figure 4:
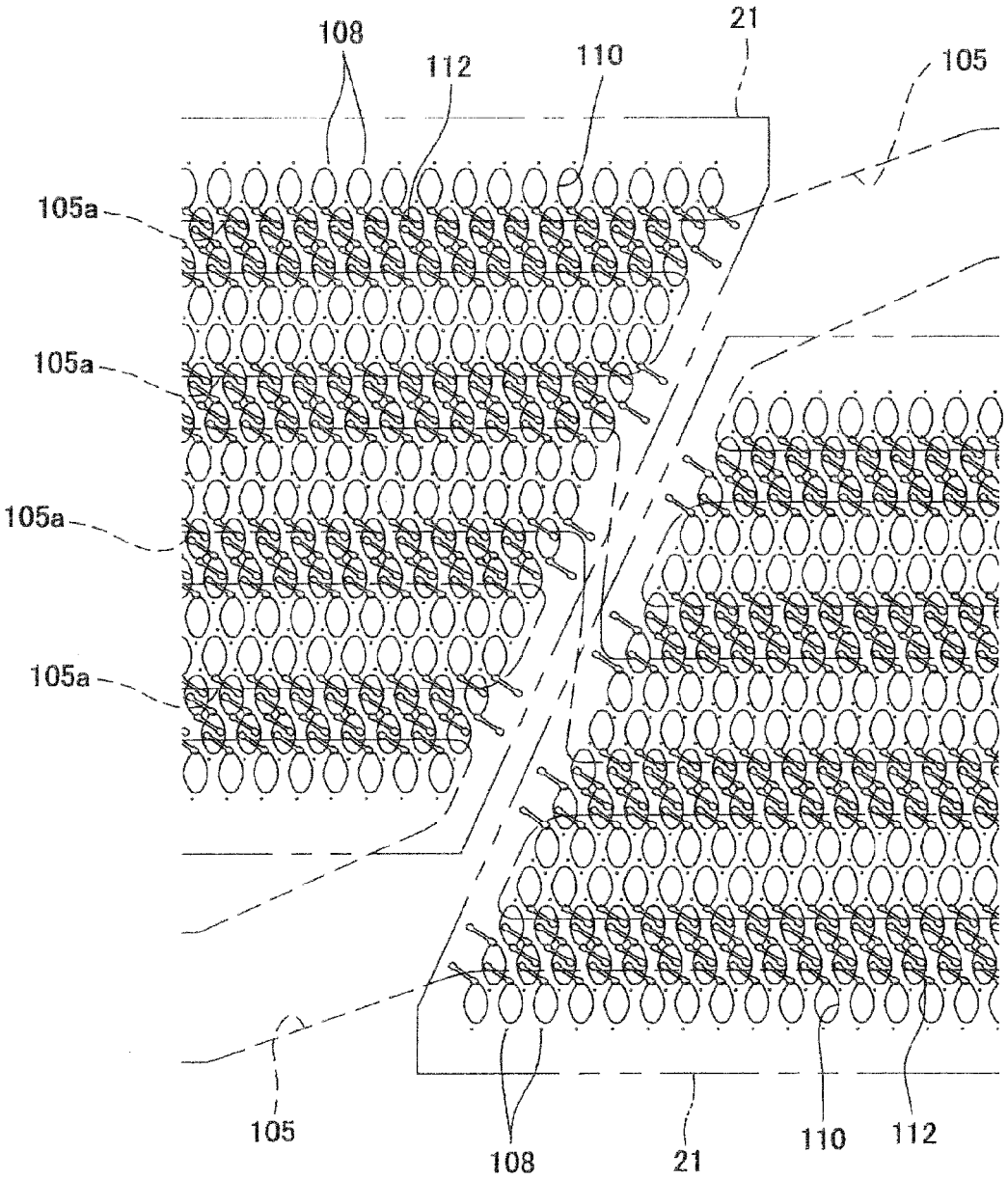
FIG. 4 is an enlarged view showing an area enclosed by a one-dot chain line shown in FIG. 3.
Figure 5:
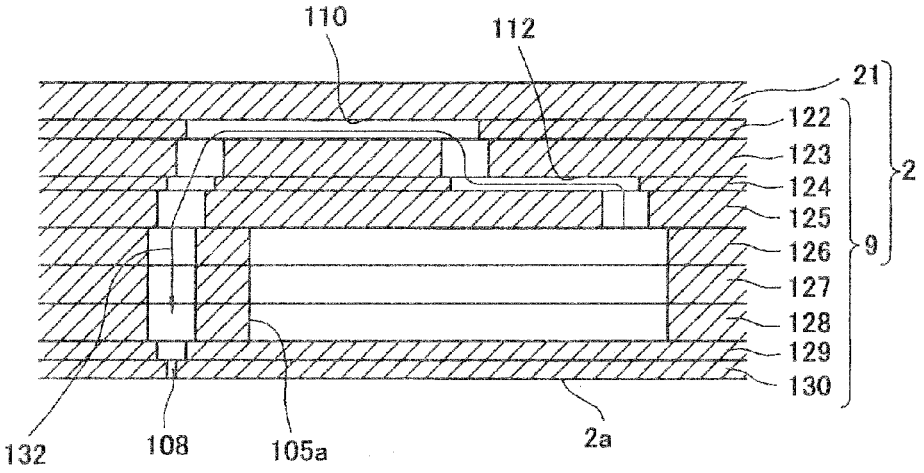
FIG. 5 is a partial cross-sectional view showing the ink-jet head shown in FIG. 4.

There will be next explained the head main body 2 in more detail with reference to FIGS. 3-5. It is noted that, in FIG. 4, pressure chambers 110, apertures 112, and the ejection openings 108 are illustrated by solid lines for easier understanding purposes though these elements should be illustrated by broken lines because these elements are located under actuator units 21.

As shown in FIGS. 3-5, the head main body 2 includes the channel unit 9 and the four actuator units 21 fixed to the upper face of the channel unit 9. The channel unit 9 has ink channels including the pressure chambers 110 and so on. The actuator units 21 include a plurality of unimorph actuators respectively corresponding to the pressure chambers 110 so as to selectively apply ejection energy to the ink in the pressure chambers 110.

The channel unit 9 is a stacked body constituted by a plurality of metal plates 122-130 formed of stainless steel and positioned and stacked on each other. The upper face of the channel unit 9 has the ten ink supply openings 105*b* opened therein which communicate respectively with the ink outlet channels 75 of the reservoir unit 71 (see FIG. 2). As shown in FIG. 3, in the channel unit 9 are formed a plurality of manifold channels 105 and a plurality of sub-manifold channels 105*a*. Each of the ink supply openings 105*b* communicates with a corresponding one of the manifold channels 105, and each of the sub-manifold channels 105*a* is included in a corresponding one of the manifold channels 105. Further, as shown in FIG. 5, in the channel unit 9 is formed a plurality of individual ink channels 132 each branched from a corresponding one of the sub-manifold channels 105*a* and extending to a corresponding one of the ejection openings 108 opened in the ejection face 2*a* via a corresponding one of the pressure chambers 110. In the ejection face 2*a*, the ejection openings 108 are formed in matrix.

There will be next explained flow of the ink in the channel unit 9. As shown in FIGS. 3-5, in the normal recording, the ink supplied from the ink outlet channels 75 of the reservoir unit 71 to the ink supply openings 105*b* is distributed to the sub-manifold channels 105*a* of the manifold channels 105. The ink in the sub-manifold channels 105*a* flows into the individual ink channels 132 including the respective apertures 112 and the respective pressure chambers 110 and reaches the respective ejection openings 108 through the respective individual ink channels 132.

There will be next explained the ink supply unit 10 in detail. As shown in FIG. 2, each ink supply unit 10 includes: (a) a sub-tank 80; (b) an ink replenish tube 81 connected to the sub-tank 80; (c) a replenish pump 91 and a replenish valve 92 provided on the ink replenish tube 81; (d) an ink supply tube 82 as one example of a supply channel and an ink returning tube 83 as one example of a return channel; (e) a purging pump 86 (as one example of a supply device) provided on the ink supply tube 82; (f) a circulation valve 87 as one example of an adjusting device provided on the ink returning tube 83; and (g) an air communicating valve 88 as one example of an air communication device connected to the sub-tank 80.

The sub-tank 80 is for storing the ink to be supplied to the ink-jet head 1. When an amount of the ink in the sub-tank 80 becomes small, the replenish valve 92 is opened and the replenish pump 91 is driven, thereby replenishing the ink stored in an ink tank 90 to the sub-tank 80 via the ink replenish tube 81. The air communicating valve 88 communicates, in its open state, an inside of the sub-tank 80 with an ambient air or interrupts, in its closed state, the communication of the sub-tank 80 with the ambient air. In the normal recording, the air communicating valve 88 is open, so that the inside of the sub-tank 80 and the ambient air communicate with each other. As a result, an air pressure in the sub-tank 80 is always kept at an atmospheric pressure regardless of the amount of the ink stored in the sub-tank 80, ensuring stable ink supply.

Figure 6:
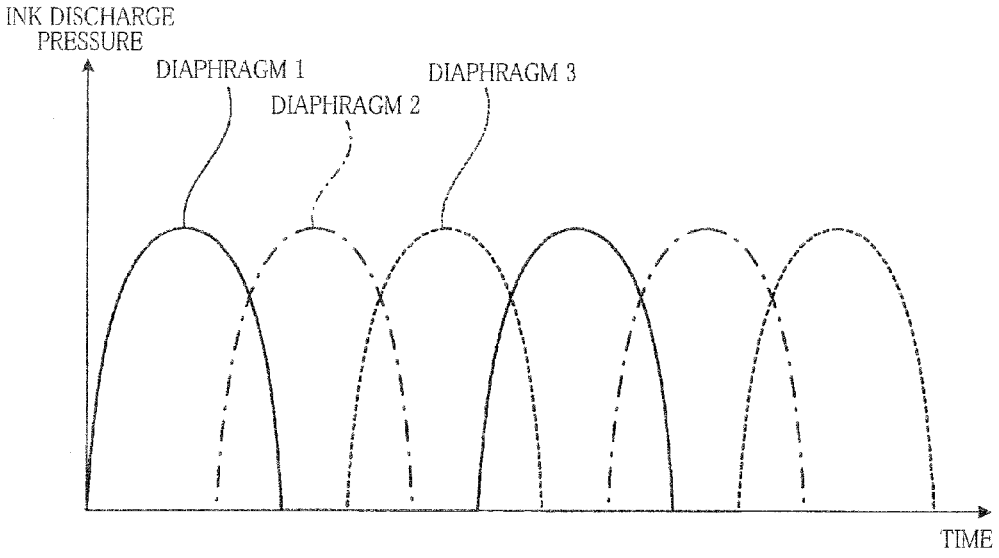
FIG. 6 is a graph showing operational characteristics of a purging pump shown in FIG. 2.

One end of the ink supply tube 82 is connected to the sub-tank 80, and the other end thereof is connected to the inlet opening 72*a* of the reservoir unit 71 via a joint 82*a*. Thus, the ink in the sub-tank 80 is supplied to the ink inlet channel 72 of the reservoir unit 71 via the ink supply tube 82. The purging pump 86 functions as a supply portion which is driven to forcibly supply the ink in the sub-tank 80 to the ink inlet channel 72 via the ink supply tube 82. Further, the purging pump 86 functions as a check valve which prevents the ink from flowing from the joint 82*a* toward the sub-tank 80 in the ink supply tube 82. It is noted that, even where the purging pump 86 is stopped, the ink in the sub-tank 80 can be supplied to the reservoir unit 71 by flowing through the ink supply tube 82. The purging pump 86 is a three-phase diaphragm pump as a volume pump, and as shown in FIG. 6, three diaphragms are driven in different phases to discharge the ink, thereby restraining a pressure variation upon the ink supply.

As shown in FIG. 2, one end of the ink returning tube 83 is connected to the sub-tank 80, and the other end thereof is connected to the outlet opening 73*a* of the reservoir unit 71 via a joint 83*a*. The circulation valve 87 is an adjustment portion configured to adjust a channel resistance value of the ink returning tube 83 between a predetermined minimum value (in an open state of the circulation valve 87) and a predetermined maximum value (in a closed state of the circulation valve 87). It is noted that, in the present embodiment, the circulation valve 87 is an open-and-close valve for changing between (a) its open state in which the flow of the ink is not interrupted at all and (b) its closed state in which the flow of the ink is completely interrupted or inhibited, but the circulation valve 87 may be a channel controlling valve capable of adjusting the channel resistance value at any value.

Figure 7:
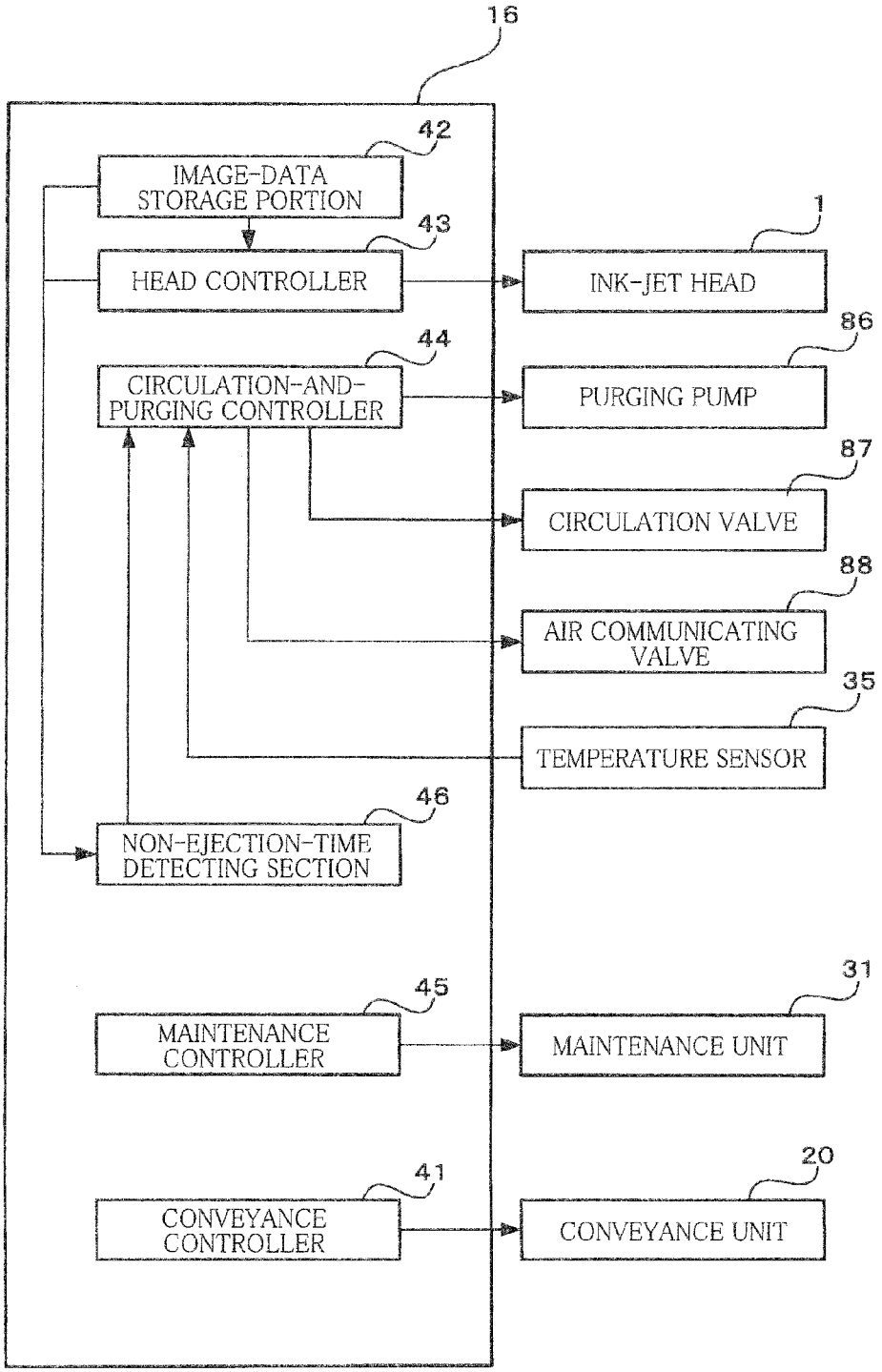
FIG. 7 is a functional block diagram of a controller shown in FIG. 1.

There will be next explained the controller 16 with reference to FIG. 7. The controller 16 includes: a Central Processing Unit (CPU); an Electrically Erasable and Programmable Read Only Memory (EEPROM) that rewritably stores programs to be executed by the CPU and data used for the programs; and a Random Access Memory (RAM) that temporarily stores data when the program is executed. The controller 16 includes various functioning sections which are constituted by cooperation of these hardwares and softwares in the EEPROM with each other. The controller 16 is configured to control entire operations of the ink-jet printer 101 and includes: a conveyance controller 41; an image-data storage portion 42; a head controller 43; a non-ejection-time detecting section 46; a circulation-and-purging controller 44; and a maintenance controller 45.

The conveyance controller 41 controls the conveyance motor of the conveyance unit 20 such that the sheet P is conveyed in the conveyance direction at a predetermined speed. The image-data storage portion 42 stores therein image data relating to an image to be recorded on the sheet P.

Figure 8:
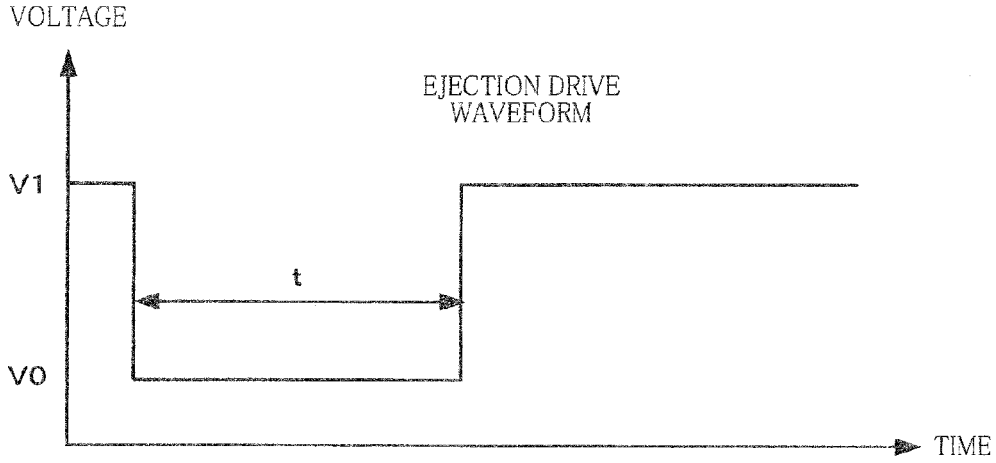
FIG. 8 is a waveform chart of an ejection driving signal produced by a head controller shown in FIG. 7.

In the normal recording, the head controller 43 produces an ejection driving signal on the basis of the image data and supplies the produced ejection driving signal to the actuator units 21. As shown in FIG. 8, the ejection driving signal is a signal including a pulse that changes from an electric potential V1 to a ground potential V0 for a predetermined length of time in a single recording cycle. This pulse width t is equal to a length of time in which a pressure wave is transmitted through a distance AL (Acoustic Length) extending from an outlet of the sub-manifold channel 105*a* to the ejection opening 108. It is noted that a waveform in FIG. 8 is a waveform corresponding to ejection of a small ink droplet and having a single pulse. A waveform corresponding to a medium-size ink droplet is constituted by successive two pulses, and a waveform corresponding to a large ink droplet is constituted by successive three pulses.

On the basis of an ink ejection history, the non-ejection-time detecting section 46 detects, for each ink jethead 1, an elapsed time from the last (most recent) ejection of the ink droplet from the ejection opening 108 to a current time. Specifically, the non-ejection-time detecting section 46 detects the elapsed time on the basis of the ejection driving signal outputted from the head controller 43 or the data stored in the image-data storage portion 42.

In the maintenance operation which will be described below, the circulation-and-purging controller 44 controls operations of the purging pump 86, the circulation valve 87, and the air communicating valve 88 of each ink supply unit 10. Specific controls of the circulation-and-purging controller 44 will be described below. It is noted that the circulation-and-purging controller 44 also controls the replenish pump 91 and the replenish valve 92 for the ink replenishing, but these are omitted in FIG. 7.

The maintenance controller 45 controls the maintenance unit 31 in the maintenance operation which will be described below.

Figure 9:
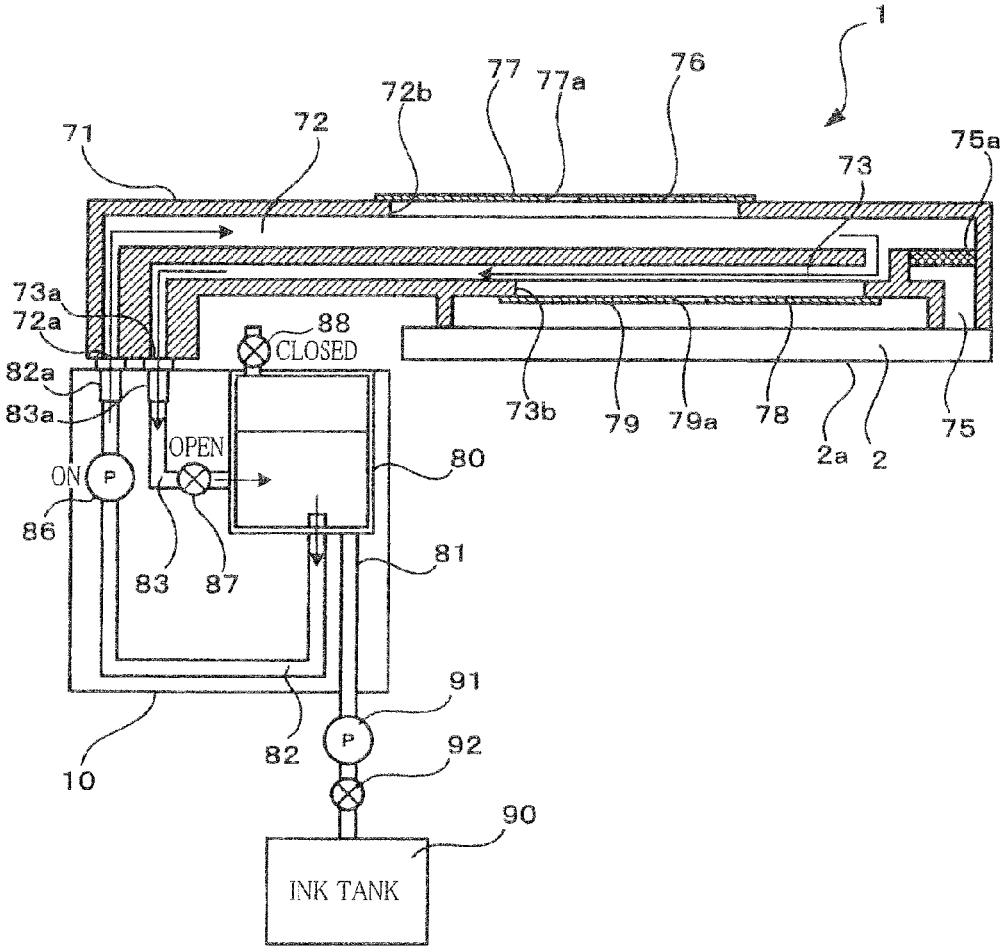
FIG. 9 is a view showing a flow of ink when the ink is circulated by a circulation-and-purging controller shown in FIG. 7.
Figure 10:
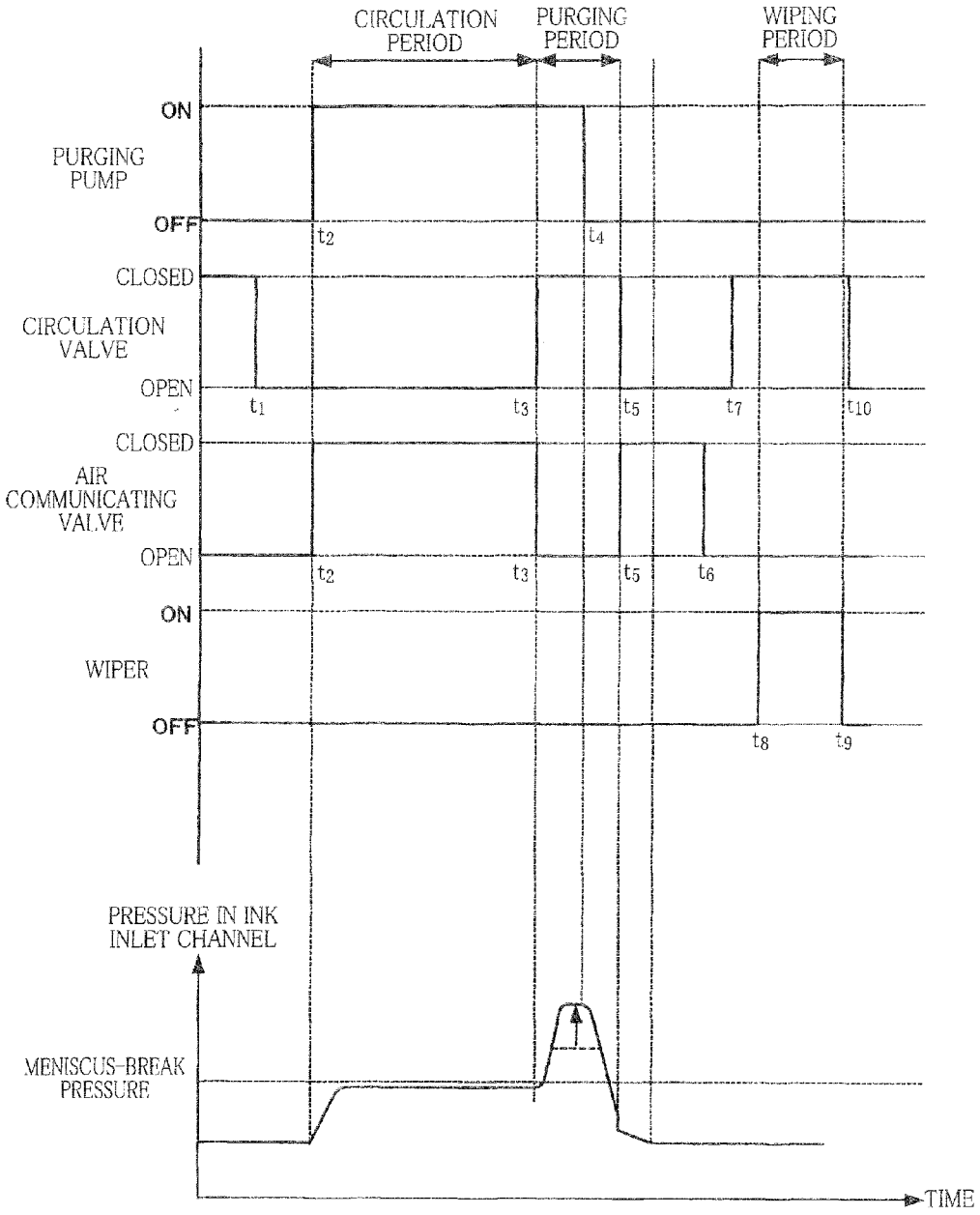
FIG. 10 is a view showing an operational sequence of the ink jet printer shown in FIG. 1.
Figure 11:
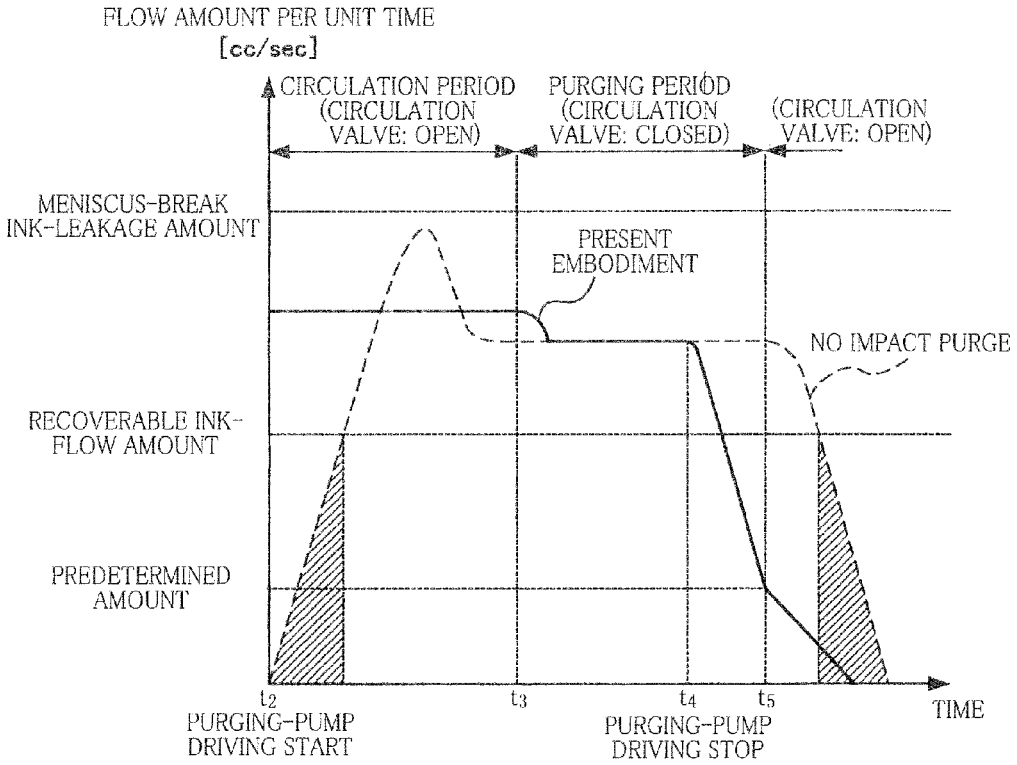
FIG. 11 is a graph showing changes of an ink-flow amount in a purging operation executed by the circulation-and-purging controller shown in FIG. 7.

There will be next explained the maintenance operation with reference to FIGS. 9-11. The maintenance operation is an operation for performing the maintenance of the ink jetheads 1 and is started when the ink jetprinter 101 is booted up, when a standby time during which the recording has not been performed has passed a specific length of time, and when a command is inputted by a user, for example. During the standby state and the normal recording, the purging pump 86 is stopped, the circulation valve 87 is closed, the air communicating valve 88 is open, the replenish pump 91 is stopped, and the replenish valve 92 is closed (see FIG. 2).

As shown in FIGS. 9 and 10, when the maintenance operation is started, the circulation-and-purging controller 44 opens the circulation valve 87 (at a time t1) and then closes the air communicating valve 88 and drives the purging pump 86 at the same time (at a time t2, a liquid circulation control is started). It is noted that the replenish pump 91 is stopped, and the replenish valve 92 is closed during the maintenance operation.

As a result, the ink in the sub-tank 80 is forcibly supplied to the ink inlet channel 72 via the ink supply tube 82. Since the circulation valve 87 is open at this time, a channel resistance in a passage from the ink inlet channel 72 to the sub-tank 80 via the discharge channel 73 and the ink returning tube 83 is less than that in a passage from the ink inlet channel 72 to the ejection openings 108 via the ink outlet channels 75 and the manifold channels 105. Thus, the ink supplied to the ink inlet channel 72 passes through the discharge channel 73 and the ink returning tube 83 in order and returns to the sub-tank 80 (that is, the ink circulation (liquid circulation) is performed) without flowing into the ink outlet channels 75. When the ink circulation is performed, the pressure of the ink rises in a channel from the purging pump 86 to the sub-tank 80 in the circulation passage. Thus, by the ink flowing by the ink circulation, air bubbles and foreign matters remaining in the ink inlet channel 72, especially the air bubbles and the foreign matters built up on the filter 75*a*, are carried through the discharge channel 73 and the ink returning tube 83 in order together with the ink, so that the air bubbles and the foreign matters are trapped in the sub-tank 80.

In order to efficiently move the air bubbles and the foreign matters to the sub-tank 80 by the ink circulation, there is a need to increase an amount (an ink-flow amount) of the flow of the ink to be supplied from the purging pump 86 per unit time (hereinafter may be referred to as "unit-time supply amount") in a range not higher than an amount (meniscus-break ink-leakage amount) of the ink at a timing when the ink starts to leak or flow from the ejection openings 108 by a break of meniscus (meniscus break) of the ink in the ejection openings 108 (see FIG. 11). That is, the amount of the ink supplied by the purging pump 86 during the ink circulation is set as large as possible in a range in which the meniscus of the ink formed in the ejection openings 108 is not broken and the ink is not discharged from the ejection openings 108. It is noted that the meniscus-break ink-leakage amount is a value obtained by actual measurement or a value calculated from a channel structure of the ink jethead 1, a height relationship between the ink jethead 1 and the sub-tank 80 in the ink-jet printer 101, viscosity of the ink, and/or so on. The meniscus-break ink-leakage amount is stored in advance. It is noted that the unit-time supply amount is set at an amount that is smaller than the meniscus-break ink-leakage amount and that is obtained by reducing a specific amount from the meniscus-break ink-leakage amount. This specific amount functions as a margin of the ink-flow amount such that the meniscus break does not occur even if a state of the meniscus has been changed by pulsation of the ink flow caused by the purging pump 86 and/or changes of environments such as ambient temperature and humidity. Further, when the purging operation is performed from the ejection openings 108 later, the ink flow in the discharge channel 73 is suddenly stopped or closed, whereby the ink pressures in the discharge channel 73 and the ink inlet channel 72 suddenly rise. The ink-flow amount per unit time is set at an amount equal to or larger than an ink amount (recoverable ink-flow amount) that can discharge the air bubbles and the foreign matters remaining in the individual ink channels from the ejection openings 108 together with the ink by this rise of the ink pressures. It is noted that the recoverable ink-flow amount is a value obtained by actual measurement and stored in advance. From another point of view, where the driving of the purging pump 86 is started in the state in which the circulation valve 87 is closed such that the ink-flow amount is the recoverable ink-flow amount, an ink amount capable of discharging the air and the foreign matters remaining in the individual ink channels from all the ejection openings 108 together with the ink can be also referred to as the recoverable ink-flow amount. That is, where the purging pump 86 is driven with the ink whose ink amount is less than the recoverable ink-flow amount, the ink may continue to be discharged only from ejection openings 108 respectively communicating with individual ink channels 132 containing relatively small amounts of air bubbles and thickened or viscous ink. In this case, even if a period for discharging the ink is made longer, the ink may not be discharged from all the ejection openings 108 together with the air and the foreign matters.

It is noted that, in the ink circulation, the ink pressures in the ink inlet channel 72 and the discharge channel 73 are relatively high when compared with in the normal recording, and accordingly the resin film 76 in the ink inlet channel 72 is held in close contact with the restraining member 77, and the resin film 78 in the discharge channel 73 is held in close contact with the restraining member 79.

In the period during which the air communicating valve 88 is closed in the ink circulation, a negative pressure is produced in the sub-tank 80. The ink in the ink inlet channel 72 is thus sucked into the sub-tank 80 via the discharge channel 73, making it difficult for the ink to flow into the ink outlet channels 75 when compared with the case where the air communicating valve 88 is open. As a result, the pressure in the ink inlet channel 72 is lowered, causing less meniscus break. Thus, when compared with the case where the air communicating valve 88 is open, the unit-time supply amount can be made larger until the pressure in the ink inlet channel 72 becomes closer to a pressure (meniscus-break pressure) at which the meniscus is broken. That is, assuming that the pressure in the ink inlet channel 72 is constant during the circulation, where the air communicating valve 88 is closed, the ink-flow amount is larger in the case where the air communicating valve 88 is open. Further, where the air communicating valve 88 is closed, the pressure in the ink inlet channel 72 during the purging period can be made larger than in the case where the air communicating valve 88 is open. Accordingly, it is possible to efficiently discharge the air bubbles and the foreign matters remaining in the individual ink channels from the ejection openings 108 together with the ink. In the present embodiment, the unit-time supply amount is an amount during the ink circulation that is larger than a maximum amount in which the ink does not leak from the ejection openings 108 per unit time where the air communicating valve 88 is open and that is equal to or less than a maximum amount in which the ink does not leak from the ejection openings 108 per unit time where the air communicating valve 88 is closed. It is noted that, in FIG. 10, a solid-line waveform and a broken-line waveform indicate pressure changes in the ink inlet channel 72, specifically, the solid-line waveform indicates the pressure changes in the channel where the unit-time supply amount is made larger as described above in the state in which the air communicating valve 88 is closed during the ink circulation (i.e., in the case of the present embodiment), and the broken-line waveform indicates the pressure changes in the channel where the air communicating valve 88 is open during the ink circulation (noted that the unit-time supply amount is not made larger).

The purging (liquid discharge) operation is started (at a time t3, a liquid discharge control is started), when the ink circulation has been performed for a length of time enough to remove the air and the foreign matters remaining in the ink inlet channel 72 from at least the ink inlet channel 72, in a state in which the ink-flow amount from the purging pump 86 per unit time is equal to or larger than the recoverable ink-flow amount. When the purging operation is started, as shown in FIGS. 10 and 11, the circulation-and-purging controller 44 closes the circulation valve 87 and opens the air communicating valve 88 at the same time. Thus, the ink flow in the discharge channel 73 is suddenly stopped by the circulation valve 87, whereby the ink pressures in the discharge channel 73 and the ink inlet channel 72 suddenly rise. As a result, the ink supplied to the ink inlet channel 72 flows into the ink outlet channels 75 without flowing into the discharge channel 73, and then the ink passes through the manifold channels 105 and the individual ink channels 132 in order and is discharged from the ejection openings 108. The discharged ink is received by a waste-ink tray, not shown.

Since the purging operation is started by closing the circulation valve 87 in the state in which the ink circulation is being performed such that the ink-flow amount from the purging pump 86 per unit time is equal to or larger than the recoverable ink-flow amount (noted that this purging operation may be hereinafter referred to as "impact purge"), the ink pressure in the ink inlet channel 72 is relatively high from a point in time just after the purging operation is started, whereby the thickened ink in the ejection openings 108 and the remaining air bubbles and foreign matters can be efficiently discharged from the ejection openings 108. If the impact purge is not performed, that is, if the purging pump 86 starts to be driven in the state in which the circulation valve 87 is closed without circulating the ink, to discharge the ink from the ejection openings 108 (a conventional technique), a length of time required for an ink pressure in each of the individual ink channels 132 to exceed a pressure at which the ink is discharged from all the ejection openings 108 becomes longer, and the ink is needlessly discharged from the ejection openings 108 until the length of time has been passed. That is, since the ink is discharged from only the ejection openings 108 respectively communicating with the individual ink channels 132 containing relatively small amounts of air bubbles and thickened ink, the ink is discharged unnecessarily. Further, in the above-described embodiment, the circulation valve 87 is closed, and the air communicating valve 88 is opened simultaneously. Thus, the pressure in the sub-tank 80 forcibly becomes the atmospheric pressure, thereby preventing the pressure in the sub-tank 80 from lowering in accordance with the discharging of the ink. Where the communication of the sub-tank 80 with the ambient air is interrupted when the ink is discharged, the ink does not flow into the sub-tank 80, and accordingly a large amount of the negative pressure may be produced in the ink when the ink is discharged, thereby hindering the operation of the purging pump 86, but where the sub-tank 80 is communicated with the ambient air when the ink is discharged, it is possible to avoid the hindrance to the operation of the purging pump 86.

When a predetermined purging amount of the ink has been discharged from the ejection openings 108, the circulation-and-purging controller 44 stops the driving of the purging pump 86 (at a time t4, a liquid-discharge stopping control is started). After the driving of the purging pump 86 has been stopped, the unit-time supply amount decreases as time passes. When the purging pump 86 has been stopped and the unit-time supply amount has become a predetermined amount that is smaller than the unit-time supply amount in the ink circulation, in other words, when the unit-time supply amount has become a predetermined amount that is less than the unit-time supply amount in the ink circulation indicated by a solid line in FIG. 11 and less than the recoverable ink-flow amount, the circulation-and-purging controller 44 opens the circulation valve 87 and closes the air communicating valve 88 at the same time, and stops the purging operation (at a time t5). It is noted that the predetermined purging amount is determined by the ink-flow amount of the purging pump 86 per unit time and a length of the purging period. The ink-flow amount per unit time and the length of the purging period for discharging the predetermined purging amount of the ink are obtained by experiment and stored in advance. The circulation-and-purging controller 44 makes the circulation period longer and the purging amount larger in accordance with increase in a temperature detected by a temperature sensor 35 or increase in a length of the elapsed time detected by the non-ejection-time detecting section 46.

As described above, by performing the ink circulation and the purging operation in order, the air bubbles and the foreign matters remaining in the ink inlet channel 72 can be discharged to an outside of the ink-jet heads 1 without flowing into downstream-side channels (e.g., the manifold channels 105, the individual ink channels 132, and the like).

After the unit-time supply amount has become zero by stopping the driving of the purging pump 86, the circulation-and-purging controller 44 opens the air communicating valve 88 at a time t6 and then closes the circulation valve 87 at a time t7.

Then, when the wiping operation has been started at a time t8, the maintenance controller 45 moves the four ink-jet heads 1 upward by a moving mechanism, not shown, and then moves the four wiper members 32 in the main scanning direction along the ejection faces 2*a* respectively facing thereto while holding distal ends of the respective wiper members 32 in contact with the respective ejection faces 2*a*. This operation removes the excessive ink adhering to the ejection faces 2*a* by the purging operation and recovers or arranges the state of the ink meniscus formed in the ejection openings 108. After the ejection faces 2*a* have been wiped at a time t9, the maintenance controller 45 returns the four wiper members 32 and the ink-jet heads 1 to their respective original positions, and the circulation-and-purging controller 44 opens the circulation valve 87 at a time t10, and the wiping operation is completed.

As described above, according to the ink-jet printer 101 as the present embodiment, the air bubbles, the foreign matters, and the like remaining in the ink inlet channel 72 can be discharged into the sub-tank 80 by the ink circulation while preventing the ink from leaking from the ejection openings 108. Further, the circulation valve 87 is closed in this state to momentarily increase the pressure in the ink inlet channel 72, whereby the ink in the ink inlet channel 72 flows into the ink outlet channels 75 so as to be discharged from the ejection openings 108. In this operation, a relatively high pressure is applied to all the ejection openings 108 from the start of the purging operation to discharge the ink in the ejection openings 108. Accordingly, it is possible to efficiently discharge the thickened ink in the ejection openings 108, the air bubbles, and the foreign matters, and it is possible to prevent the ink from being discharged needlessly. Further, in the above-described embodiment, the unit-time supply amount is reduced during the purging period by stopping the driving of the purging pump 86. Thus, the unit-time supply amount at the end of the purging period is less than that during the ink circulation, whereby the pressure in the ink inlet channel 72 is lowered. Accordingly, even where a meniscus withstanding pressure of the meniscus formed in the ejection openings 108 has been lowered because the ink discharged from the ejection openings 108 in a previous purging operation has adhered to defining portions of the ejection openings 108, it is possible to prevent the ink from leaking from the ejection openings 108 after the end of the purging period.

Further, since the unit-time supply amount is reduced by stopping the driving of the purging pump 86, the unit-time supply amount can be easily reduced. Further, since the pressure in the ink inlet channel 72 is lowered, the purging operation can be quickly completed.

Further, since the negative pressure is produced in the sub-tank 80 by closing the air communicating valve 88 during the ink circulation to interrupt the communication of the sub-tank 80 with the ambient air, the ink of the ink inlet channel 72 is sucked into the sub-tank 80 via the discharge channel 73 and the ink returning tube 83, making more difficult for the ink in the ink inlet channel 72 to flow into the ink outlet channels 75. As a result, the ink is less likely to leak from the ejection openings 108.

Further, in the above-described embodiment, since the circulation valve 87 is closed, and the air communicating valve 88 is opened at the same time when the purging operation is started, the pressure of the inside of the sub-tank 80 forcibly becomes the atmospheric pressure, thereby preventing the pressure in the sub-tank 80 from lowering in accordance with the discharging of the ink. Accordingly, since the ink in the ink inlet channel 72 is not sucked into the sub-tank 80 via the discharge channel 73, the ink supply of the purging pump 86 to the ink outlet channels 75 is not hindered. As a result, it is possible to prevent the ink discharging from the ejection openings 108 from being unstable or stopped.

Further, in the above-described embodiment, since the circulation valve 87 is opened and the air communicating valve 88 is closed during the purging period, the ink discharging from the ejection openings 108 is stopped, and the negative pressure is produced in the sub-tank 80. Accordingly, it is possible to quickly stop discharging the ink from the ejection openings 108, and it is possible to prevent the ink from leaking from the ejection openings 108 after the end of the purging period.

Further, in the above-described embodiment, the circulation valve 87 is completely closed after the end of the purging operation. Accordingly, it is possible to prevent the ink having adhered to the ejection face 2*a* by the purging operation from being sucked into the ejection openings 108 by, e.g., a water head difference between the ink-jet head 1 and the sub-tank 80.

Further, in the above-described embodiment, the wiping operation is performed after the end of the purging operation. Accordingly, it is possible to remove the ink and the foreign matters adhering to the ejection faces 2*a* and to recover or arrange the state of the ink meniscus of the ejection openings 108.

Further, in the above-described embodiment, the resin film 76 partly constitutes the inner wall face of the ink inlet channel 72, and the resin film 78 partly constitutes the inner wall face of the discharge channel 73. Thus, it is possible to efficiently restrain the changes of the ink pressures in the ink inlet channel 72 and the discharge channel 73. Accordingly, the ink can be supplied to the individual ink channels at a stabilized pressure. Further, when the resin films 76, 78 are deformed in the ink circulation, a volume of the channel increases, lowering the pressure in the sub-tank 80. Accordingly, the ink is less likely to leak from the ejection openings 108.

<Modification>

Figure 12:
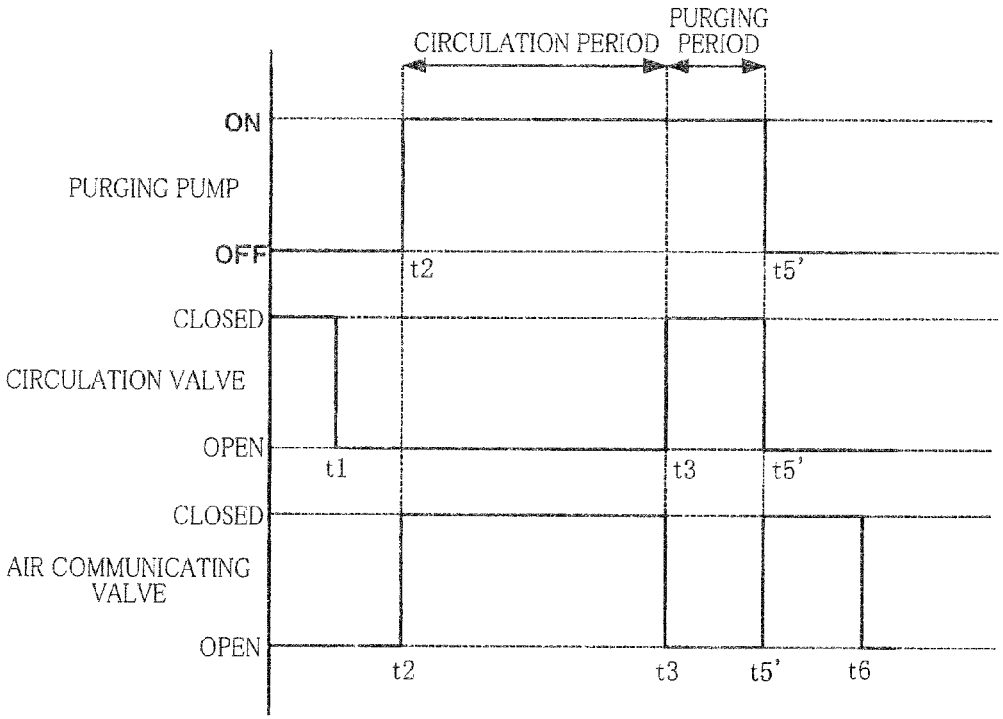
FIG. 12 is a view showing an operational sequence of an ink jetprinter as a modification of the present embodiment.

There will be next explained a modification of the present embodiment. In the above-described embodiment, the driving of the purging pump 86 is stopped before the purging operation is stopped, but the present invention is not limited to this embodiment. For example, as shown in FIG. 12, the purging operation may be stopped by opening the circulation valve 87, closing the air communicating valve 88, and stopping the driving of the purging pump 86 at the same time at a time t5'. Where the printer 101 is configured in this manner, it is easier to execute the control for stopping the purging operation. Since there is a time delay until the purging operation is stopped after the circulation valve 87 is opened and the air communicating valve 88 is closed, the unit-time supply amount is reduced in that period.

While the embodiment and the modification of the present invention have been described above, it is to be understood that the invention is not limited to the details of the illustrated embodiment and modification, but may be embodied with various changes and modifications, which may occur to those skilled in the art, without departing from the spirit and scope of the invention. For example, in the above-described embodiment, the circulation valve 87 is selectively opened or closed, but a channel controlling valve capable of changing the channel resistance value at any value may be employed as the circulation valve 87. In this case, the channel controlling valve may change the channel resistance value so as to change the channel resistance value stepwise or continuously. Further, the circulation valve 87 does not need to close the ink channel completely. Further, in the above-described embodiment, the channel resistance value of the ink returning tube 83 is adjusted by controlling the circulation valve so as to reduce a cross-sectional area of the ink channel of the ink returning tube 83, but, in order to adjust the channel resistance value of the ink returning tube 83, an outer circumferential face of the ink returning tube 83 may be pinched by a pinching member to deform the ink returning tube 83 so as to reduce the cross-sectional area of the ink channel of the ink returning tube 83.

Further, in the above-described embodiment, when the air communicating valve 88 is closed, the communication of the inside of the sub-tank 80 with the ambient air is completely interrupted, but the inside of the sub-tank 80 and the ambient air may communicate with each other through a slight clearance in a state in which the air communicating valve 88 is closed, as long as a negative pressure is produced in the sub-tank 80 during the ink circulation.

Further, in the above-described embodiment, the air communicating valve 88 is closed during the ink circulation and opened during the purging period, but may be opened and closed at any timings. For example, the air communicating valve 88 may be closed during all the ink circulation period and the purging period and may be closed for at least a part of the ink circulation period and the purging period. It is noted that the air communicating valve 88 is preferably closed during a period for restraining the ink from leaking from the ejection openings 108. Further, the ink supply unit 10 may not include the air communicating valve 88.

Further, in the above-described embodiment, the wiping operation is performed in the maintenance operation, but the wiping operation may be omitted.

In addition, in the above-described embodiment, the resin film 76 partly constitutes the inner wall face of the ink inlet channel 72, and the resin film 78 partly constitutes the inner wall face of the discharge channel 73, but the reservoir unit may not include at least one of the resin films 76, 78.

Further, in the above-described embodiment, the ink-flow amount from the purging pump 86 per unit time during the ink circulation is smaller than the meniscus-break ink-leakage amount, but the ink-flow amount may be equal to or larger than the meniscus-break ink-leakage amount as long as an amount of the ink leaking from the ejection openings 108 during the ink circulation is very small. For example, where the ink is leaking from only a small number of the ejection openings, the meniscus break occurs in the ejection openings, but an amount of the leaking ink is so small that effects for preventing the ink from being consumed needlessly can be obtained as a whole.

Further, in the above-described embodiment, the purging pump 86 is provided by the three-phase diaphragm pump as one of the volume pumps, but may be another volume pump such as a tube pump and may be a pump other than the volume pump such as an impeller pump.

Further, in the above-described embodiment, each actuator unit 21 is provided by the unimorph piezoelectric actuator, but the actuator unit may be constituted by bimorph piezoelectric actuators. Further, the present invention may be applied to a thermal liquid ejection apparatus including heating elements.

Figure 13:
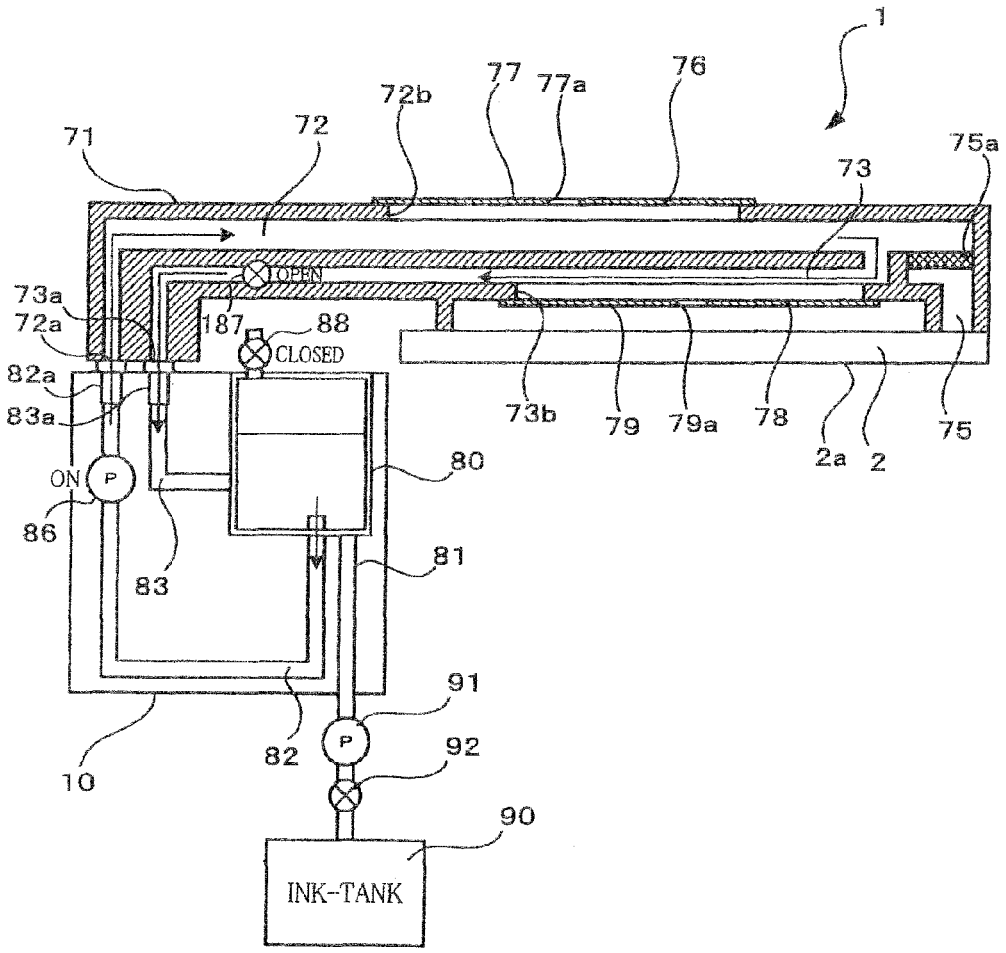
FIG. 13 is a view for explaining another modification.

Further, in the above-described embodiments, the circulation valve 87 is provided on the ink returning tube 83, but as shown in FIG. 13, a circulation valve 187 may be provided on the discharge channel 73 at a position in a predetermined area from the outlet opening 73*a* to adjust the channel resistance value of the discharge channel 73. Where the printer is configured in this manner, the circulation valve 187 is positioned near the ejection openings 108, making it possible to quickly start discharging the ink from the ejection openings 108 in the purging operation. It is noted that the term "in the predetermined area from the outlet opening 73*a*" means an area from the outlet opening 73*a* to a position at which the discharge channel 73 is branched from the ink inlet channel 72 (i.e., in the discharge channel 73).

The present invention is applicable to a liquid ejection apparatus configured to eject liquid other than the ink. Further, the present invention is applicable to a facsimile machine, a copying machine, and the like, in addition to the printer.

What is claimed is:

1. A liquid ejection apparatus comprising:

a liquid ejection head including:

an inlet opening into which liquid flows;

an outlet opening from which the liquid having flowed into the inlet opening flows;

an inside channel communicating the inlet opening and the outlet opening with each other; and a plurality of ejection openings through which is ejected the liquid having flowed through a plurality of individual channels that are branched from the inside channel;

a tank storing the liquid to be supplied to the liquid ejection head;

a supply channel communicating the tank and the inlet opening with each other;

a return channel communicating the tank and the outlet opening with each other;

a supply device configured to supply the liquid in the tank to the inside channel via the supply channel;

an adjusting device configured to adjust a channel resistance value of the return channel between a predetermined minimum value and a predetermined maximum value; and a controller configured to control the supply device and the adjusting device, wherein the controller is configured to start a liquid circulation control for circulating the liquid through the supply channel, the inside channel, and the return channel in order by controlling (i) the adjusting device such that the channel resistance value is less than the predetermined maximum value and (ii) the supply device to supply the liquid into the inside channel, wherein, when the liquid is circulated by the liquid circulation control, the controller starts a liquid discharge control for discharging the liquid from the plurality of the ejection openings by increasing the channel resistance value to a value larger than the channel resistance value in the liquid circulation control, wherein, when the liquid is discharged by the liquid discharge control, the controller starts a liquid-discharge stopping control for stopping the discharge of the liquid from the plurality of the ejection openings, by decreasing the channel resistance value to a value less than the channel resistance value in the liquid discharge control, wherein the controller is configured to control the supply device such that a unit-time supply amount that is an amount of the liquid supplied to the inside channel per unit time at a time when the discharge of the liquid from the plurality of the ejection openings is stopped by the liquid-discharge stopping control is less than a unit-time supply amount in the liquid circulation control, and wherein the controller is configured to start to control the supply device to decrease the unit-time supply amount at the same time when the controller starts to control the adjusting device to decrease the channel resistance value in the liquid-discharge stopping control.

2. The liquid ejection apparatus according to claim 1, wherein the controller is configured to control the supply device such that the unit-time supply amount in the liquid circulation control becomes a predetermined amount that does not cause the liquid to be discharged from the plurality of the ejection openings.

3. The liquid ejection apparatus according to claim 1, wherein the controller is configured to decrease the unit-time supply amount by controlling the supply device to stop supplying the liquid.

4. The liquid ejection apparatus according to claim 1, further comprising an air communication device controlled by the controller so as to communicate an inside of the tank with an ambient air or interrupt the communication of the inside of the tank with the ambient air, wherein the controller is configured to control the air communication device such that the communication of the inside of the tank with the ambient air is interrupted in at least a part of a period of the liquid circulation control.

5. The liquid ejection apparatus according to claim 4, wherein the controller is configured to control the air communication device such that the inside of the tank communicates with the ambient air in at least a part of a period of the liquid discharge control.

6. The liquid ejection apparatus according to claim 5, wherein the controller is configured to control the adjusting device and supply device to perform the liquid-discharge stopping control such that the channel resistance value in the liquid-discharge stopping control is less than the channel resistance value in the liquid discharge control and such that the inside of the tank is interrupted from the ambient air.

7. The liquid ejection apparatus according to claim 1, wherein the liquid ejection head has an ejection face having the plurality of the ejection openings formed therein, and wherein the liquid ejection apparatus further comprises a wiping device configured to wipe the ejection face when the discharge of the liquid from the plurality of the ejection openings is stopped.

8. The liquid ejection apparatus according to claim 1, wherein at least a part of inner wall faces of the inside channel and the supply channel is formed of a flexible material.

* * * * *